US005589325A

United States Patent [19]

Kuno et al.

[11] Patent Number: 5,589,325

[45] Date of Patent: Dec. 31, 1996

[54] SILVER HALIDE PHOTOGRAPHIC MATERIAL

[75] Inventors: Koichi Kuno; Shuzo Suga, both of Kanagawa, Japan

[73] Assignee: Fuji Photo Film Co., Ltd., Kanagawa, Japan

[21] Appl. No.: 589,210

[22] Filed: Jan. 22, 1996

Related U.S. Application Data

[63] Continuation of Ser. No. 331,193, Oct. 28, 1994, abandoned.

[30] Foreign Application Priority Data

Nov. 1, 1993 [JP] Japan ..... 5-293825

[51] Int. Cl.[6] ..... G03C 1/12

[52] U.S. Cl. ..... 430/576; 430/581; 430/599; 430/607

[58] Field of Search ..... 430/576, 581, 430/599, 607

[56] References Cited

U.S. PATENT DOCUMENTS

| | | | |
|---|---|---|---|
| 3,650,759 | 3/1972 | Sonoda et al. | 430/607 |
| 5,290,676 | 3/1994 | Nagaoka et al. | 430/583 |
| 5,310,645 | 5/1994 | Ikegawa et al. | 430/574 |
| 5,364,755 | 11/1994 | Miyamoto et al. | 430/584 |

FOREIGN PATENT DOCUMENTS

| | | | |
|---|---|---|---|
| 3-130758 | 6/1991 | Japan | 430/607 |
| 3-130759 | 6/1991 | Japan | 430/607 |

*Primary Examiner*—Thorl Chea

*Attorney, Agent, or Firm*—Sughrue, Mion, Zinn, Macpeak & Seas

[57] ABSTRACT

A silver halide photographic material comprising a support having provided thereon at least one light-sensitive silver halide emulsion layer, wherein the emulsion is spectrally sensitized with at least one compound selected from the compounds represented by the following formulae (1) and (2) and contains a compound represented by the following formula (5).

$$[DYE+(G)_n \quad (1)$$

$$[DYE+(G^-)_n \quad (2)$$

(5)

3 Claims, No Drawings

SILVER HALIDE PHOTOGRAPHIC MATERIAL

This is a Continuation of application Ser. No. 08/331,193, filed Oct. 28, 1994 now abandoned.

FIELD OF THE INVENTION

The present invention relates to a silver halide photographic material. More specifically, the present invention relates to a silver halide photographic material having a high sensitivity and a low residual color after processing.

BACKGROUND OF THE INVENTION

In recent years, speeding-up of an image formation processing of a silver halide photographic material has been desired. However, when the processing speed is increased, processing time required for an achromatic reaction of dyestuffs or sensitizing or desensitizing dyes contained in the light-sensitive material or an elution of these dyestuffs or dyes from the light-sensitive material cannot be ensured thereby causing a problem in that residual colors originated from these dyestuffs and dyes become remarkable.

Hitherto, a discoloration efficiency has increased by making these dyes water-soluble, or a processing solution has been improved for increasing the discoloration efficiency. More specifically, known procedures for reducing the residual color include (1) a method of adding a water-soluble stilbene compound, a non-ionic surface active agent, or a mixture thereof to a developing solution, (2) a method for destroying dyes by treating a photographic element after bleaching and fixing with an oxidizing agent, and (3) a method for using, as a bleaching bath, a persulfuric acid bleaching bath, as described in *Research Disclosure*, Vol. 207, No. 20733 (July, 1981). However, these methods are not sufficiently effective when a degree of the residual color is high, and also these methods are not suitable, in particular, to a rapid processing for discoloration since they do not positively accelerate a desorption of the sensitizing dyes and an elution process.

Further, the increase in the water-solubility of dyes causes problems other than the residual color, for example, a decreased sensitivity or an increased variation in the sensitivity with a passage of time.

SUMMARY OF THE INVENTION

An object of the present invention is to provide a silver halide photographic material having a low residual color after processing without deteriorating the photographic properties such as a sensitivity.

This and other objects of the present invention can be achieved by a silver halide photographic material comprising a support having provided thereon at least one light-sensitive silver halide emulsion layer, wherein the emulsion is spectrally sensitized with at least one compound selected from the compounds represented by the following formulae (1) and (2) and contains a compound represented by the following formula (5):

$$[DYE](G)_n \quad (1)$$

$$[DYE](G^-)_n \quad (2)$$

wherein DYE represents a methine dye; G and $G^-$ each represents a substituent of the methine dye and is a group represented by the following formula (3) or (4); and n is an integer of from 1 to 3:

$$-T^1-G^1NHG^2 \quad (3)$$

$$-T^1-G^1N^0G^2 \quad (4)$$

wherein $T^1$ represents a divalent linking group; $G^1$ represents a carbonyl group (—CO—), a sulfinyl group (—SO—) or a sulfonyl group (—$SO_2$—); $G^2$ represents —CO—$T^2$, —SO—$T^2$, —$SO_2$—$T^2$ or a cyano group (—CN); and $T^2$ represents a monovalent group:

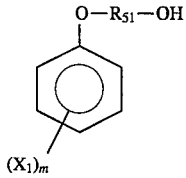

(5)

wherein $R_{51}$ represents an alkylene group; $X_1$ represents a halogen atom, a nitro group, an alkyl group, a substituted or unsubstituted amino group, —CO—$R_{52}$ or —$SO_3M$, in which $R_{52}$ represents a hydrogen atom, —OM, an alkyl group, an alkoxy group or a substituted or unsubstituted amino group; M represents a hydrogen atom, an alkali metal atom or an atomic group necessary for forming a monovalent cation; and m represents 0 or an integer of from 1 to 5.

DETAILED DESCRIPTION OF THE INVENTION

In formula (1) or (2), the methine dye represented by DYE represents a structure of photographic sensitizing dyes, desensitizing dyes or photographic dyes having a poor sensitizing sensitivity used for absorbing light of an unnecessary wavelength such as polynucleus methine dyes such as cyanine dyes, merocyanine dyes and rhodacyanine dyes, oxonol dyes, styryl dyes, benzylidene dyes and arylidene dyes.

Examples of preferred dye structures represented by DYE include those represented by the following formulae (6) to (8):

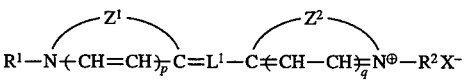

(6)

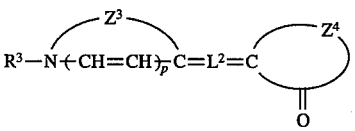

(7)

-continued

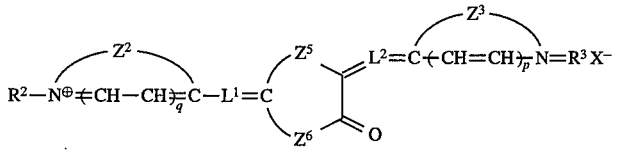

(8)

wherein $Z^1$, $Z^2$ and $Z^3$ and each represents an atomic group necessary for forming a 5- or 6-membered nitrogen-containing heterocyclic ring together with [—N—(CH=CH)$_p$C—] or [—C=(CH—CH)$_p$N$^+$—]. Examples thereof include the following groups, with the proviso that, for the sake of convenience, the quaternary salt of the heterocyclic ring is described in the name of the corresponding non-ionic form thereof: a thiazole nucleus (for example, thiazole, 4-methylthiazole, 4-phenylthiazole, 4,5-dimethylthiazole, 4,5-diphenylthiazole), a benzothiazole nucleus (for example, benzothiazole, 4-chlorobenzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylthiobenzothiazole, 5,6-dimethylbenzothiazole, 5-hydroxy-6-methylbenzothiazole, tetrahydrobenzothiazole, 4-phenylbenzothiazole), a naphthothiazole nucleus (for example, naphtho[2,1-d]thiazole, naphtho[1,2-d]thiazole, naphtho[2,3-d]thiazole, 5-methoxynaphtho[1,2-d]thiazole, 7-ethoxynaphtho[2,1-d]thiazole, 8-methoxynaphtho[2,1-d]thiazole, 8-methylthionaphtho[1,2-d]thiazole, 5-methoxynaphtho[2,3-d]thiazole), a thiazoline nucleus (for example, thiazoline, 4-methylthiazoline, 4-nitrothiazoline), an oxazole nucleus (for example, oxazole, 4-methyloxazole, 4-nitroxazole, 5-methyloxazole, 4-phenyloxazole, 4,5-diphenyloxazole, 4-ethyloxazole), a benzoxazole nucleus (for example, benzoxazole, 5-chlorobenzoxazole, 5-methylbenzoxazole, 5-bromobenzoxazole, 5-fluorobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzoxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, 5-ethoxybenzoxazole), a naphthoxazole nucleus (for example, naphtho[2,1-d]oxazole, naphtho[1,2-d]oxazole, naphtho[2,3-d]oxazole, 5-nitronaphtho[2,1-d]oxazole), an oxazoline nucleus (for example, 4,4-dimethyloxazoline), a selenazole nucleus (for example, 4-methylselenazole, 4-nitroselenazole, 4-phenylselenazole), a benzoselenazole nucleus (for example, benzoselenazole, 5-chlorobenzoselenazole, 5-nitrobenzoselenazole, 5-methoxybenzoselenazole, 5-hydroxybenzoselenazole, 6-nitrobenzoselenazole, 5-chloro-6-nitrobenzoselenazole), a naphthoselenazole nucleus (for example, naphtho[2,1-d]-selenazole, naphtho[1,2-d]selenazole), a 3,3-dialkylindolenine nucleus (for example, 3,3-dimethylindolenine, 3,3-diethylindolenine 3,3-dimethyl-5-cyanoindolenine, 3,3-dimethyl-6-nitroindolenine, 3,3-dimethyl-5-nitroindolenine 3,3-dimethyl-5-methoxyindolenine, 3,3,5-trimethylindolenine, 3,3-dimethyl-5-chloroindolenine), an imidazole nucleus (for example, 1-alkylimidazole, 1-alkyl-4-phenylimidazole, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethylbenzimidazole, 1-alkylnaphtho[1,2-d]imidazole, 1-allyl-5,6-dichlorobenzimidazole, 1-allyl-5-chlorobenzimidazole, 1-arylimidazole, 1-arylbenzimidazole, 1-aryl-5-chlorobenzimidazole, 1-aryl-5,6-dichlorobenzimidazole, 1-aryl-5-methoxybenzimidazole, 1-aryl-5-cyanobenzimidazole, 1-arylnaphtho[1,2-d]imidazole, wherein the alkyl group as a substituent on the above-described heterocyclic ring has preferably from 1 to 8 carbon atoms such as an unsubstituted alkyl group (e.g., methyl, ethyl, propyl, butyl) and a hydroxyalkyl group (e.g., 2-hydroxyethyl, 3-hydroxypropyl), and more preferably a methyl group or an ethyl group; and the above-described aryl group as a substituent on the above-described heterocyclic ring represents an unsubstituted phenyl group, a phenyl group substituted by a halogen atom such as a chlorine atom, a phenyl group substituted by an alkyl group such as a methyl group, or an alkoxy group substituted by an alkoxy group such as a methoxy group; a pyridine nucleus (for example, 2-pyridine, 3-pyridine, 5-methyl-2-pyridine, 3-methyl-4-pyridine), a quinoline nucleus (for example, 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, isoquinoline, 6-nitro-1-isoquinoline, 3,4-dihydro-1-isoquinoline, 6-nitro-3-isoquinoline), an imidazo[4,5-b]quinoxaline nucleus (for example, 1,3-diethylimidazo[4,5-b]quinoxaline, 6-chloro-1,3-diallylimidazo[4,5-b]quinoxaline), a benzotellurazole nucleus (for example, benzotellurazole, 5-methylbenzotellurazole, 5-methoxybenzotellurazole), a naphthotellurazole nucleus (for example, naphtho[1,2-d]tellurazole), an oxadiazole nucleus, a thiadiazole nucleus, a tetrazole nucleus and a pyrimidine nucleus.

$Z^4$ represents an atomic group necessary for forming a 5- or 6-membered nitrogen-containing heterocyclic ring together with [—C—CO—]. Examples thereof include a rhodanine nucleus, a 2-thiohydantoin nucleus, a 2-thioxoxazolidin-4-one nucleus, a 2-pyrazolin-5-one nucleus, a barbituric acid nucleus, a 2-thiobarbituric acid nucleus, a thiazolidin-2,4-dione nucleus, a thiazolidine-4-one nucleus, an isoxazolone nucleus, a hydantoin nucleus and an indanedione nucleus.

Also, $Z^4$ may be an open-chain type of the structure in which the ring derived from acetylacetone, malondinitrile, ethyl acetoacetate and ethyl cyanoacetate is opened.

Examples of substituents on the 5- or 6-membered ring formed by $Z^4$ include an unsubstituted alkyl group, a substituted alkyl group, an unsubstituted aryl group, a substituted aryl group and a heterocyclic group, and specific examples thereof include an alkyl group having from 1 to 18, preferably from 1 to 7, and more preferably 1 to 4, carbon atoms (for example, methyl, ethyl, propyl, isopropyl, butyl, isobutyl, hexyl, octyl, dodecyl, octadecyl), a substituted alkyl group (for example, an aralkyl group (e.g., benzyl, 2-phenylethyl), a hydroxyalkyl group (for example, 2-hydroxyethyl, 3-hydroxypropyl), a carboxylalkyl group (for example, 2-carboxyethyl, 3-carboxypropyl, 4-carboxybutyl, carboxymethyl), an alkoxyalkyl group (for example, 2-methoxyethyl, 2-(2-methoxyethoxy)ethyl), a sulfoalkyl group (for example, 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfatoalkyl group (for example, 3-sulfatopropyl, 4-sulfatobutyl), a substituted alkyl group substituted by a heterocyclic ring (for example, 2-(pyrrolidin-2-one-1-yl)ethyl, tetrahydrofurfuryl, 2-morpholinoethyl), a 2-acetoxyethyl group, a carbomethoxymethyl group, a 2-methanesulfonylaminoethyl group, an allyl group, an unsubstituted aryl group (for example, phenyl, 2-naphthyl), a substituted aryl group (for example, 4-carboxyphenyl, 4-sulfophenyl, 3-chlorophenyl, 3-methylphenyl) and a heterocyclic group (for example, 2-pyridyl, 2-thiazolyl).

$Z^5$ and $Z^6$ each represents an atomic group necessary for forming a 5- or 6-membered nitrogen-containing heterocyclic ring together with [—C—CO—] and [—C—] and the 5- or 6-membered ring formed by them together with [—C—CO—] and [—C—] corresponds to the 5-or 6-membered ring formed by $Z^4$ having two carbonyl or thiocarbonyl groups in total from which an oxo or thioxo group at the appropriate position has been removed.

$L^1$ represents an unsubstituted methine group, a substituted methine group or a trivalent group which is formed by bonding an odd number of these groups through an conjugated double bond, and $L^2$ represents a tetravalent group formed by boding an even number of a methine group or a substituted methine group so as to form a conjugated bond.

Examples of substituents on the methine group represented by $L^1$ and $L^2$ include an alkyl group (for example, methyl and ethyl), an aryl group (for example, phenyl), an aralkyl group (for example, benzyl), an alkoxy group (for example, methoxy, ethoxy), an aryloxy group (for example, phenoxy), an alkylthio group (for example, methylthio, ethylthio), an arylthio group (for example, phenylthio) and a halogen atom (for example, chlorine, bromine), or the substituents on the methine chain may be combined with each other to form a 4- to 6-membered ring.

$R^1$, $R^2$ and $R^3$ each represents a substituted or unsubstituted alkyl group, for example, an alkyl group having from 1 to 18, preferably from 1 to 7, and more preferably from 1 to 4, carbon atoms. Examples of the unsubstituted alkyl group include a methyl group, an ethyl group, a propyl group, an isopropyl group, a butyl group, an isobutyl group, a hexyl group, an octyl group, a dodecyl group and an octadecyl group, and examples of the substituted alkyl group include an aralkyl group (for example, benzyl, 2-phenylethyl), a hydroxyalkyl group (for example, 2-hydroxyethyl, 3-hydroxypropyl), a carboxyalkyl group (for example, 2-carboxyethyl, 3-carboxypropyl, 4-carboxybutyl, carboxymethyl), an alkoxyalkyl group (for example, 2-methoxyethyl, 2-(2-methoxyethoxy)ethyl), a sulfoalkyl group (for example, 2-sulfoethyl, 3-sulfopropyl, 3-sulfobutyl, 4-sulfobutyl, 4-sulfo-3-methylbutyl, 2-(3-sulfopropoxy)ethyl, 2-hydroxy-3-sulfopropyl, 3-sulfopropoxyethoxyethyl), a sulfatoalkyl group (for example, 3-sulfatopropyl and 4-sulfatobutyl), an alkyl group substituted by a heterocyclic ring (for example, 2-(pyrrolidin-2-one-1-yl)ethyl, tetrahydrofurfuryl), a 2-acetoxyethyl group, a carbomethoxymethyl group, a 2-methanesulfonylaminoethyl group and an allyl group. Also, $R^1$, $R^2$ and $R^3$ each may form a ring containing the methine group at the α-position thereof.

p represents 0 or 1.

$X^-$ represents a counter anion to the quaternary nitrogen cation. $X^-$ supplies an anionic charge in a number required for neutralizing the electric charge of the quaternary nitrogen cation and is not necessarily a monovalent anion. Examples of the anion include a halogen ion such as $F^-$, $Cl^-$, $Br^-$ and $I^-$; an alkylsulfonic acid ion such as $SO_4^{2-}$, $HSO_4^-$ and $CH_3OSO_3^-$; a sulfonic acid ion such as a p-toluenesulfonic acid ion, a methanesulfonic acid ion and a trifluoromethanesulfonic acid ion; a carboxylic acid ion such as an acetic acid ion, a trifluoroacetic acid ion and an oxalic acid ion; a phenolate ion such as $PF_6^-$, $BF_4^-$, $ClO_4^-$, $IO_4^-$, $PO_4^{3-}$, $NO_3^-$ and a picric acid ion.

The divalent linking group represented by $T^1$ is preferably an alkylene group, an arylene group, an ether bond, a thioether bond, an ester bond, an amide bond, a sulfonamide bond or a combination of these groups, and the total number of carbon atoms in the group is from 0 to 8, n is preferably 1 or 2. In particular, in formula (2), n is preferably 1.

The group represented by $T^2$ is preferably an alkyl group, an aryl group, an amino group, an alkoxy group or an aryloxy group having from 1 to 8 carbon atoms, and more preferably an alkyl group having from 1 to 4 carbon atoms.

Preferred combinations of the group represented by G and the group represented by DYE include the following formulae (9) to (18):

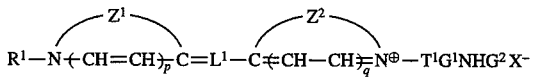

(9)

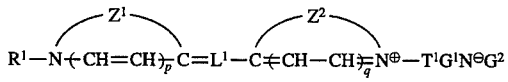

(10)

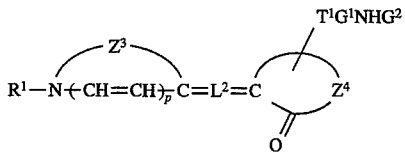

(11)

-continued (12)

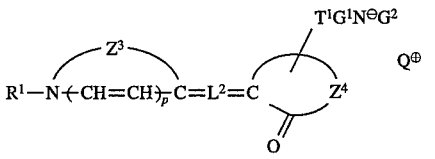

(13)

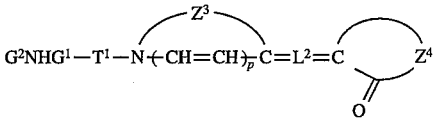

(14)

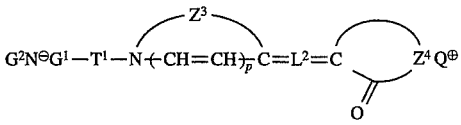

(15)

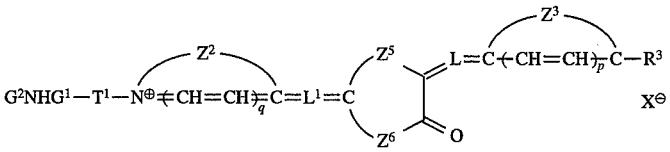

(16)

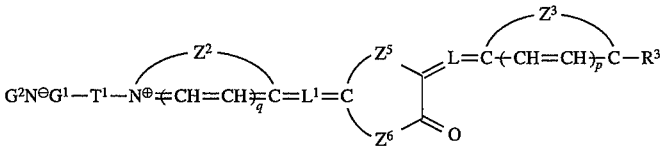

(17)

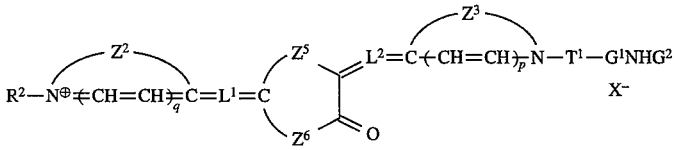

(18)

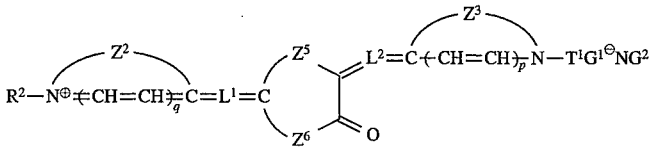

Of the compounds represented by formula (1) or formula (2), preferred compounds are those represented by the following formula (19) or (20), and the compounds represented by formula (20) are more preferred.

(19)

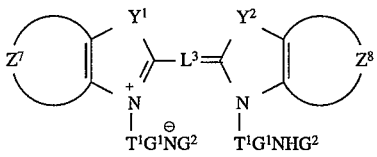

(20)

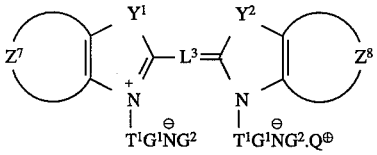

wherein $T^1$, $G^1$ and $G^2$ have the same meaning as those defined above for formula (3) or (4), respectively; $Y^1$ and $Y^2$ each represents an oxygen atom, a sulfur atom, a selenium atom, —$NR^4$—, in which $R^4$ has the same meaning as $R^1$ or $R^2$, or —$CR^5R^6$—, in which $R^5$ and $R^6$ each has the same meanings as $R^1$ or $R^2$; $Z^7$ and $Z^8$ each represents an atomic group necessary for forming a benzene ring or a naphthalene ring which may be substituted, $L^3$ represents a methine group which may be substituted, or a trivalent group formed by linking 3, 5 or 7 methine groups via a conjugated double bond; and Q represents an onium ion for neutralizing the molecular charge.

Specific examples of the compounds are illustrated below, but the compounds of the present invention are not limited thereto:

I-1
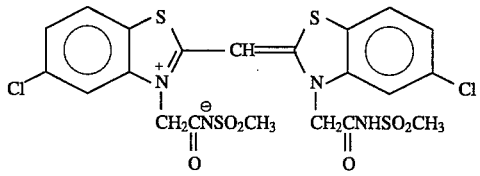
I-2
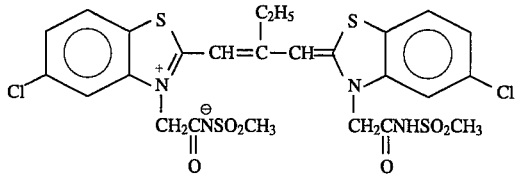
I-3
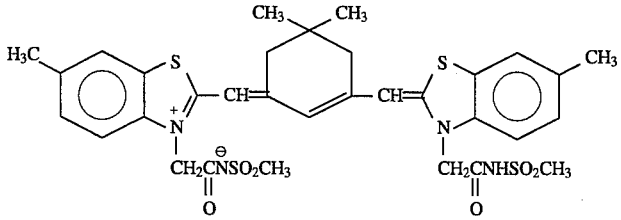
I-4
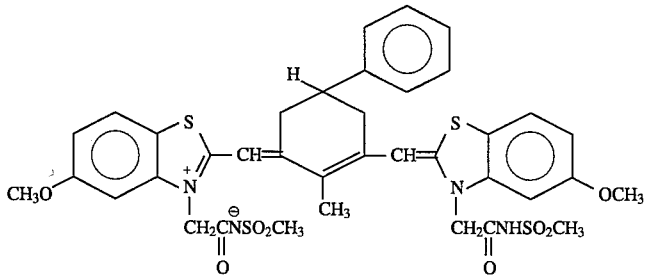
I-5
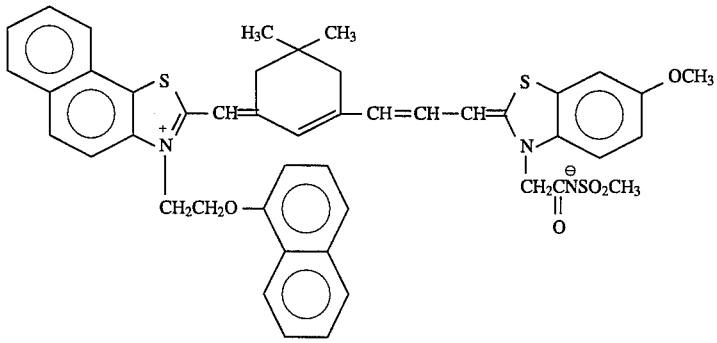
I-6
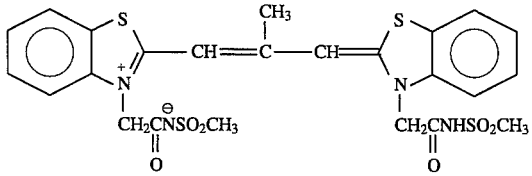
I-7
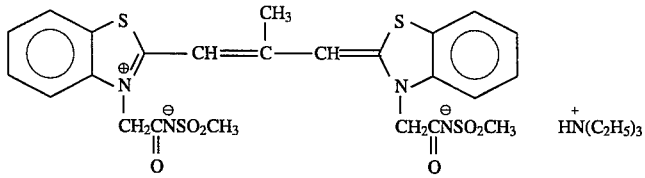

-continued
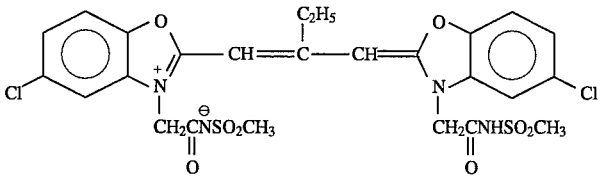
I-8
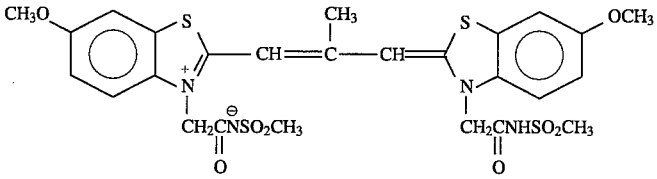
I-9
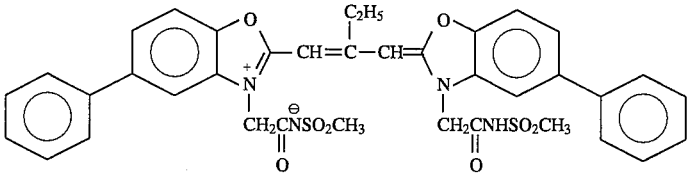
I-10
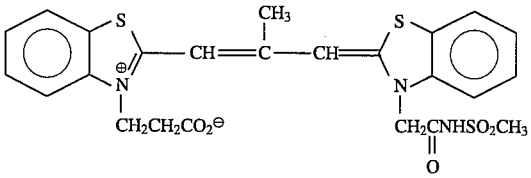
I-11
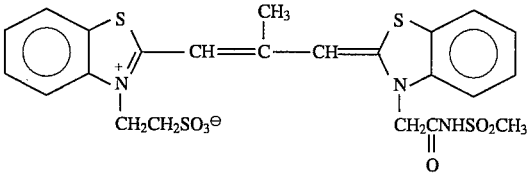
I-12
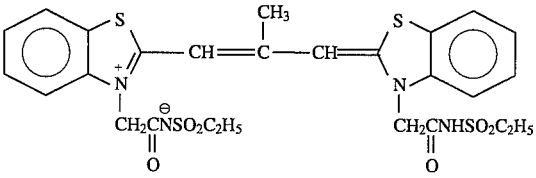
I-13
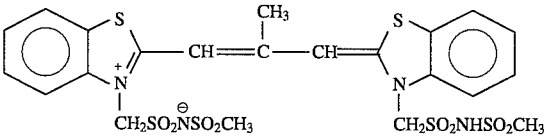
I-14
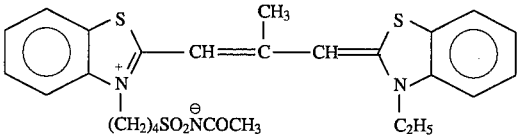
I-15
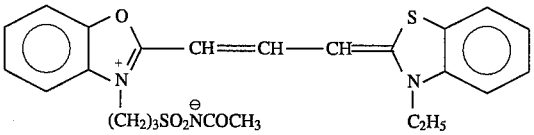
I-16

-continued
I-17
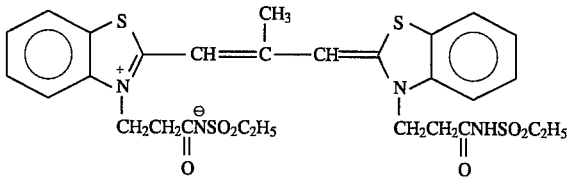
I-18
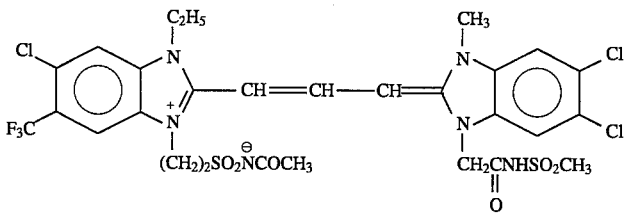
I-19
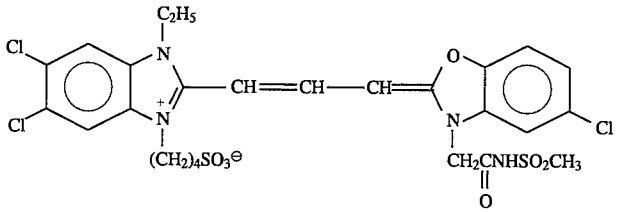
I-20
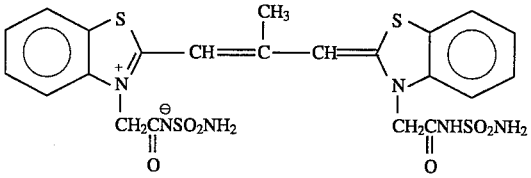
I-21
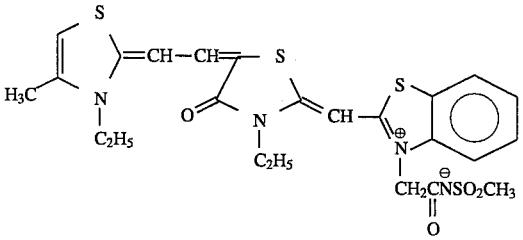
I-22
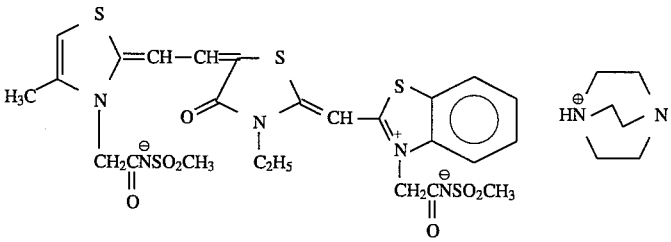
I-23
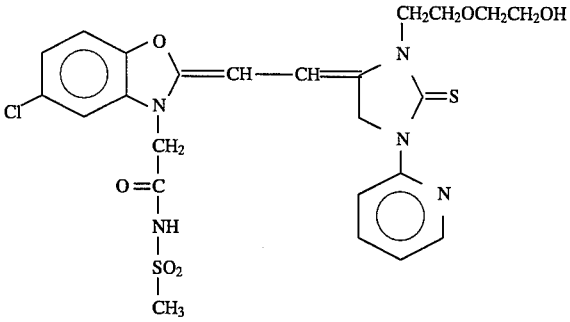

-continued

I-24

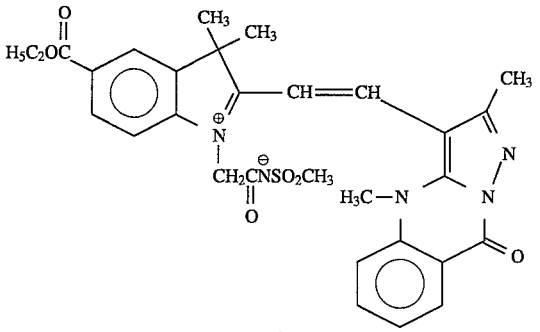

I-25

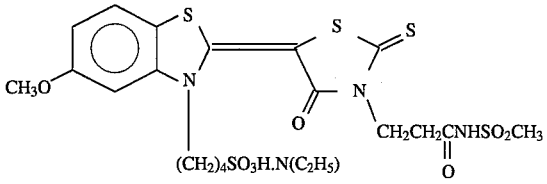

I-26

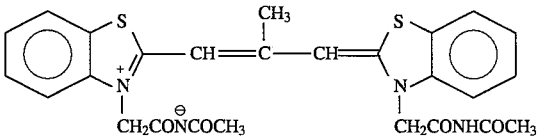

I-27

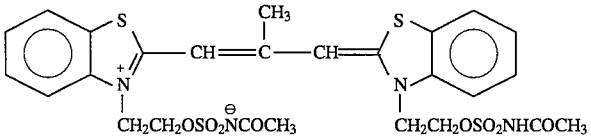

I-28

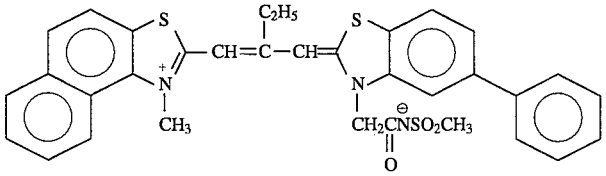

I-29

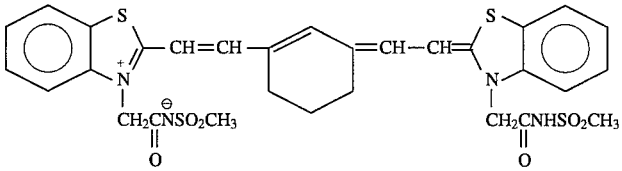

I-30

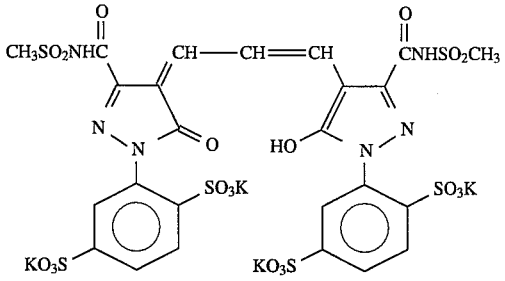

In order to incorporate the above-described methine compound into a silver halide emulsion (hereinafter sometimes referred to as "a photographic emulsion"), the methine compound, for example, may be directly dispersed in the emulsion or it may be dissolved in water or a solvent such as methanol, ethanol, propanol, methyl cellosolve and 2,2,3,3-tetrafluoropropanol, alone or a mixed solvent thereof, and then added to the emulsion. Also, the methine compound may be added to the emulsion in the form of an aqueous solution thereof which is prepared in the presence of an acid or a base as described in JP-B-44-23389, JP-B-44-27555 and JP-B-57-22089 (the term "JP-B" as used herein means an examined Japanese patent publication) or in the form of an aqueous solution for a colloidal dispersion thereof which is prepared in the presence of a surface active agent as described in U.S. Pat. Nos. 3,822,135 and 4,006,025. Alternatively, the methine compound may be added to the emulsion by dissolving the compound in a substantially water-immiscible solvent such as phenoxyethanol, and then dispersing the solution in water or a hydrophilic colloid. Also, the methine compound may be directly dispersed in a hydrophilic colloid and then the resulting dispersion may be added to the emulsion as described in JP-A-53-102733 and JP-A-58-105141.

The sensitizing-desensitizing dye (a sensitizing or desensitizing dye) or dyestuff used in the present invention may be dissolved using an ultrasonic vibration as disclosed in U.S. Pat. No. 3,485,634. Further, as other methods for adding the dye or the dyestuff used in the present invention to the emulsion by dissolving or dispersing it, the method described in U.S. Pat. Nos. 3,482,981, 3,585,195, 3,469,987, 3,425,835 and 3,342,605, British Patents 1,271,329, 1,038,029 and 1,121,174, U.S. Pat. Nos. 3,660,101 and 3,658,546 can be utilized.

The dye and the dyestuff can be used in any of the steps of the production of the photographic emulsion, or can be present in any stage after the preparation and just before coating. Examples of the former case is a step for forming silver halide grains, a step for physical ripening, and a step for chemical ripening. For example, they can be added during the grain formation as described in JP-A-55-26589 (the term "JP-A" as used herein means an unexamined published Japanese patent application).

The sensitizing-desensitizing dye used in the present invention used in an amount of from $5\times10^{-9}$ mol to $2\times10^{-2}$ mol, preferably from $5\times10^{-6}$ to $2\times10^{-2}$ mol, and more preferably from $1\times10^{-5}$ to $1\times10^{-2}$ mol, per mol of the silver halide in the silver halide photographic emulsion.

The compound represented by formula (5) is described hereinafter in detail.

In formula (5), $R_{51}$ represents a straight chain or branched chain alkylene group (for example, ethylene, propylene and methylethylene), preferably a lower alkylene group, and more preferably an alkylene group having from 1 to 6 carbon atoms.

$X_1$ represents a halogen atom (for example, chlorine, bromine, fluorine), a nitro group, an alkyl group (for example, lower alkyl such as methyl, ethyl, isopropyl and tert-butyl), —$COR_{52}$, —$SO_3M$ or a substituted or unsubstituted amino group, wherein $R_{52}$ represents a hydrogen atom, —OM, an alkyl group (for example, lower alkyl such as methyl, n-butoxy, and isopropoxy), an alkoxy group (for example, lower alkoxy such as methoxy, n-butoxy and isopropoxy), or a substituted or unsubstituted amino group; and M represents a hydrogen atom, an alkali metal atom or an atomic group necessary for forming a monovalent cation, m represents 0 or an integer of from 1 to 5. A preferred number of carbon atoms of the alkyl group and the alkoxy group is from 1 to 6.

M represents a hydrogen atom, an alkali metal atom or an atomic group necessary for forming a monovalent cation.

The compound represented by formula (5) is preferably added in an amount of 0.05 mol or more, preferably from 0.05 mol to 2.0 mol, per mol of the silver halide.

Typical examples of the compounds represented by the formula (5) are shown below, but the compounds of the formula (5) of the present invention are not limited thereto.

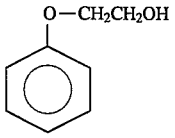

II-1

-continued

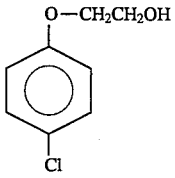

II-2

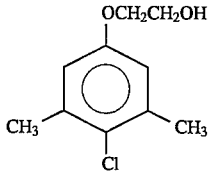

II-3

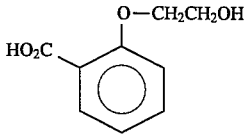

II-4

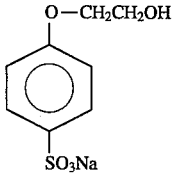

II-5

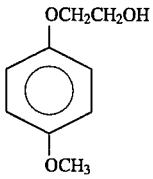

II-6

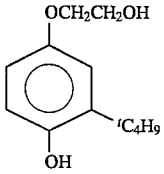

II-7

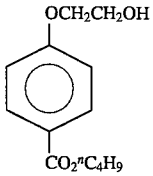

II-8

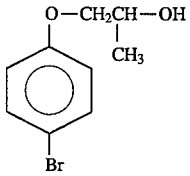

II-9

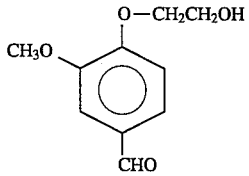

II-10

-continued

II-11

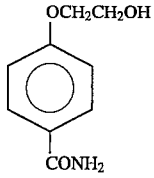

II-12

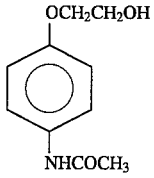

II-13

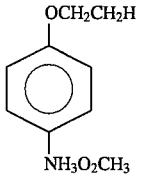

II-14

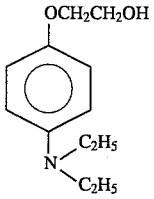

II-15

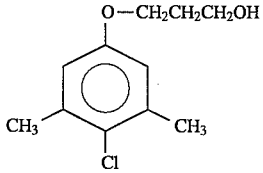

II-16

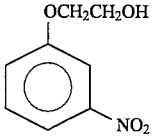

II-17

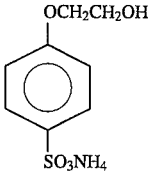

II-18

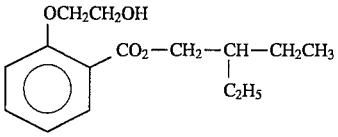

II-19

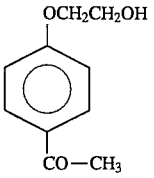

-continued

II-20

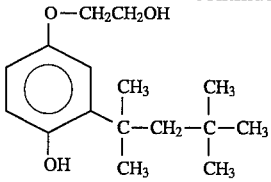

These illustrated compounds are generally easily available as commercial products of reagents. Also, the corresponding phenol compounds can be easily synthesized by the reaction of ethylene oxides or the like as intermediates.

For the silver halide photographic emulsion used in the present invention, any of silver bromide, silver iodobromide, silver iodochlorobromide, silver chlorobromide and silver chloride can be used an a silver halide. Also, any crystalline phase of the silver halide grains can be used.

The above-described silver halide emulsion may comprise tabular grains in which grains having a thickness of 0.5 μm or less and preferably 0.3 μm or less, a diameter of preferably 0.6 μm or more, and an average aspect ratio of 5 or more are at a proportion of 50% or more of the total projected area. Also, it may be an emulsion of monodisperse in which grains having a grain size in the range of ±40% of the average grain diameter are at a proportion of 95% or more of the total numbers of the grains.

The silver halide grains may have different phases between the inside and surface layers or may be composed of a uniform phase. Further, the silver halide grains may be grains in which a latent image is mainly formed on the surface thereof (for example, a negative type emulsion), or grains in which a latent image is mainly formed inside the grains (for example, an internal latent image type emulsion and a previously fogged direct reversal type emulsion).

The photographic emulsion used in the present invention can be prepared by using the method described in, for example, P. Glafkides, *Chimie et Physique Photorraphique*, Paul Montel, 1967, G. F. Duffin, *Photoghaphic Emulsion Chemistry*, Focal Press, 1966, and V. L. Zelikman et al., *Making and Coating Photographic Emulsion*, Focal Press, (1964).

More specifically, any of the acidic method, the neutral method and the ammonia method can be used, and, as the manner of reaction of the soluble halogen salts, any of the one-side mixing method, the simultaneous mixing method or a combination thereof can be used. Also, a method for forming an emulsion by placing grains in an excess of silver ions (a so-called reverse mixing method) can be used.

As one type of the simultaneous mixing methods, a method comprising maintaining a pAg in the liquid phase for producing the silver halide at a constant value, i.e., a controlled double-jet method can be used. According to this method, a silver halide emulsion having a regular crystal form and a substantially uniform grain size can be obtained.

Two or more silver halide emulsions formed separately may be used as a mixture thereof.

Solvents for silver halide, such as ammonia, potassium rhodanide, ammonium thiocyanate, thioether compounds (e.g., those described in U.S. Pat. Nos. 3,271,157, 3,574,628, 3,704,130, 4,297,439 and 4,276,374), thione compounds (e.g., those described in JP-A-53-144319, JP-A-53-82408, JP-A-55-77737) and amine compounds (e.g., those described in JP-A-54-100717) can be used to control the growth of the silver halide grains during the formation of the grains.

Cadmium salts, zinc salts, thallium salts, iridium salts or complex salts thereof, rhodium salts or complex salts thereof, iron salts or complex salts thereof may be coexistent during the formation of the silver halide grains or the physical ripening of the grains.

Also, the internal latent image emulsion used in the present invention includes an emulsion containing a hetero metal as described in, for example, U.S. Pat. Nos. 2,592,250, 3,206,313, 3,447,927, 3,761,276 and 3,935,014.

The silver halide emulsion is generally chemically sensitized. For the chemical sensitization, for example, a method as described in H. Prieser, *Die Grundlagendor Photographischen Prozesse mit Silver Halogeniden*, Akademische Verlagegesellschaft, 1968, pages 675–734, can be used.

That is, the sulfur sensitization method using a sulfur-containing compound which is capable of reacting with an active gelatin or silver (for example, a thiosulfate, a thiourea, a mercapto compound or a rhodamine); the reduction sensitization method using a reductive substance (for example, a stannous salt, an amine, a hydrazine derivative, a formamidinesulfinic acid or a silane compound); the noble metal sensitization method using a noble metal compound (for example, a metal complex salt, as well as a complex salt of the metal of the Group VIII of the Periodic Table such as Pt, Rh, Ir or Pd) can be used alone or in a combination thereof.

More specific chemical sensitizers include a sulfur sensitizer such as allyl thiocarbamide, thiourea, sodium thiosulfate and cystein; a noble metal sensitizer such as potassium aurate, aurous thiosulfate and potassium chloropalladate; and a reductive sensitizer such as tin chloride, phenylhydrazine and reductone.

The use of a selenium sensitizer is also effective.

The selenium compounds which can be used are unstable selenium compounds and/or non-unstable selenium compounds, and are used while stirring an emulsion for a predetermined period of time at a high temperature, preferably at 40° C. or more.

The unstable selenium compounds which can be used are preferably those described in JP-B-44-15748, JP-B-43-13489, JP-A-4-25832 and JP-A-4-109240. Specific examples of the unstable selenium sensitizers include isoselenocyanates (for example, aliphatic isoselenocyanates such as allyl isoselenocyanate), selenoureas, selenoketones, selenoamindes, selenocarboxylic acids (for example 2-selenopropionic acid, 2-selenoacetic acid), selenoesters, diacyl selenides (for example, bis(3-chloro-2,6-dimethoxybenzoyl) selenide), selenophosphates, phosphine selenides and colloidal selenium metals.

The preferred examples of the unstable selenium compounds are described above, but the present invention is not limited to these compounds. Generally, it is understood by the skilled artisan that, in the unstable selenium compounds as sensitizers for the photographic elements, the structure of these compounds is not an important factor as long as selenium contained therein is unstable, and that the organic moiety in the molecule of the selenium sensitizer does not have any function except that it bears selenium and allows selenium to be present in an unstable state. In the present invention, unstable selenium compounds of the above-described broad concept can be advantageously used.

The non-unstable selenium compounds are disclosed in JP-B-46-4553, JP-B-52-34492 and JP-B-52-34491, and examples of the non-unstable selenium compounds include selenious acid, potassium selenocyanate, selenazoles, quaternary salts of selenazoles, diaryl selenides, diaryl diselenides, dialkyl selenides, dialkyl diselenides, 2-selenazolidinedione, 2-selenoxazolidinethione, and derivatives thereof.

The silver halide emulsion of the present invention may also contain sensitizers such as polyoxyethylene compounds, polyoxypropylene compounds, and compounds having a quaternary ammonium group.

The above-described photographic emulsion may contain various compounds for the purpose of preventing fog in the production steps, during the storage and in the photographic processings of the light-sensitive material. More specifically, various compounds which are known as anti-foggants or stabilizers can be added to the emulsion, and such compounds include, for example, azoles such as benzothiazolium salt, nitroindazoles, triazoles, benzotriazoles, benzimidazoles (in particular, a nitro- or halogen-substituted compound); heterocyclic mercapto compounds such as mecaptothiazoles, mercaptobenzothiazoles, mecaptobenzimidazoles, mercaptothiadiazoles, mercaptotetrazoles (in particular, 1-phenyl-5-mercaptotetrazole), mercaptopyrimidines; the above-described heterocyclic mercapto compounds having a water-soluble group such as a carboxyl group or a sulfon group; thioketo compounds such as oxazolinethione; azaindenes such as tetraazaindenes (in particular, 4-hydroxy-substituted (1,3,3a,7)tetrazaindens); benzenethiosulfonic acids; and benzenesulfinic acids. More preferably, at least one of 1-phenyl-5-mercaptotetrazole compounds (e.g., 1-phenyl-5-mercaptotetrazole, 1-(4-carboxyphenyl)-5-mercaptotetrazole, 1-(3-sulfophenyl)-5-mercaptotetrazole, 1-(3-methylcarbamoylphenyl)-5-mercaptotetrazole) is contained.

The silver halide emulsion can contain a polymer latex comprising a homopolymer or copolymer of, for example, an alkyl acrylate, an alkyl methacrylate, acrylic acid or glycidyl acrylate as disclosed in U.S. Pat. Nos. 3,411,911, 3,411,912, 3,142,568, 3,325,286 and 3,547,650, and JP-B-45-5331 for improving the dimensional stability and the physical properties of the film in the photographic material.

When the silver halide emulsion is used as a light-sensitive material for a lithographic printing, a polyalkylene oxide compound which increases an infections development effect can be used. For example, the compounds disclosed in U.S. Pat. Nos. 2,400,532, 3,294,537 and 3,294,540, French Patents 1,491,805 and 1,596,673, JP-B-40-234466, JP-A-60-156423, JP-A-54-18726 and JP-A-56-161933. Preferred examples thereof include a condensate of a polyalkylene oxide comprising at least 10 units of an alkylene oxide having from 2 to 4 carbon atoms (e.g., ethylene oxide, propylene-1,2-oxide, butylene-1,2-oxide), preferably ethylene oxide, and a compound containing at least one active hydrogen atom such as water, an aliphatic alcohol, an aromatic alcohol, an aliphatic acid, an organic amine and a hexitol derivative; or a block polymer of two or more polyalkylene oxides. More specifically, polyalkylene glycol alkyl ethers, polyalkylene glycol aryl ethers, polyalkylene glycol alkyl aryl ethers, polyalkylene glycol esters, polyalkylene glycol aliphatic amides, polyalkylene glycol amines, polyalkylene glycol block copolymers and polyalkylene glycol graft polymers can be used as the polyalkylene oxide compounds. The polyalkylene oxide compounds which can be used has a molecular weight of from 300 to 15,000, preferably from 600 to 8,000. The amount of these polyalkylene oxides to be added is preferably from 10 mg to 3 g per mol of a silver halide. These compounds can be added at an optional stage in the production steps.

The silver halide photographic emulsion used in the present invention can contain color couplers such as a cyan coupler, a magenta coupler, a yellow coupler and a compound for dispersing the couplers.

More specifically, the emulsion may contain a compound which is capable of developing a color by the oxidation coupling with an aromatic primary amine developing solution (for example, a phenylenediamine derivative and an aminophenol derivative) in the color development processing. For example, 5-pyrazolone couplers, pyrazolobenzimidazole couplers, cyanoacetylcoumalone couplers, and closed-chain acylacetonitrile couplers are used as magenta couplers; acylacetoamide couplers (for example, benzoylacetoanilides, pivaloylacetoanilides) are used as yellow couplers; and naphthol couplers and phenol couplers are used as cyan couplers. These couplers are desirably non-diffusible types having a hydrophobic group which is called a ballast group in the molecular thereof. The coupler may be either 4-equivalent or 2-equivalent relative to the silver ion. Also, the coupler may be a colored coupler having a color correction effect, or a coupler which releases a development inhibitor as the development proceeds (a so-called DIR coupler).

Further, in addition to the DIR coupler, the emulsion may contain a non-color DIR coupling compound which produces a colorless product through a coupling reaction and which releases a development inhibitor.

The silver halide emulsion may contain a water-soluble dyestuff (for example, an oxonol dyestuff, a hemioxonol dyestuff, a merocyanine dyestuff) as a filter dyestuff or for preventing irradiation and for other various purposes.

The silver halide emulsion may contain various surface active agents for various purposes, for example, as a coating aid and an antistatic agent, for improvement in sliding ability, emulsification and dispersion, prevention of adhesion and improvement in photographic characteristics (for example, for accelerating the development, increasing the contrast, and sensitization).

For example, non-ionic surface active agents such as saponin (a steroid type), alkylene oxide derivatives (for example, polyethylene glycol), polyethylene glycol alkyl ethers, glycidol derivatives, aliphatic acid esters of polyhydric alcohols, and alkyl esters of saccharides; anionic surface active agents such as alkylcarbonic acid salts, alkylsulfonic acid salts, alkylbenzenesulfonic acid salts, and alkylsulfuric acid esters; and cationic surface active agents such as alkylamine salts, aliphatic or aromatic quaternary ammonium salts, heterocyclic quaternary ammonium salts such as pyridinium and imidazolium. Further, fluorine-containing surface active agents are preferred as antistatic agents.

In carrying out the present invention, the following conventional fading inhibitor can be used together. Also, in the present invention, the color image stabilizer may be used alone or in combination of two or more stabilizers. The known fading inhibitors include hydroquinone derivatives, gallic acid derivatives, p-alkoxyphenols, p-oxyphenol derivatives and bisphenols.

The photographic emulsion may contain an inorganic or organic hardening agent. For example, a hardening agent include chromium salts (e.g., chromium alum, chromium acetate), aldehydes (e.g., formaldehyde, glyoxale, glutaraldehyde), active vinyl compounds (e.g., 1,3,4-triacryloylhexahydro-s-triazine, 1,3-vinylsulfonyl-2-propanol), active halogen compounds (e.g., 2,4-dichloro-6-hydroxy-s-triazine) can be used alone or in combination.

The silver halide photographic material of the present invention may contain a hydroquinone derivative, an aminophenol derivative and gallic acid derivative as a color antifoggant.

In the light-sensitive material of the present invention, colloidal silver and dyestuffs are used for preventing irradiation, antihalation, in particular, for the separation of spectral sensitivity distribution in each of the light-sensitive layers, and for ensuring the safety to a safelight.

Such dyestuffs include oxonol dyestuffs having a pyrazolone nucleus, a barbitur nucleus or a barbituric acid nucleus disclosed in U.S. Pat. Nos. 506,385, 1,177,429, 1,131,844, 1,338,799, 1,385,371, 1,467,214. 1,438,102, 1,533,516, JP-A-48-85130, JP-A-49-114420, JP-A-52-117123, JP-A-55-161233, JP-A-59-111640, JP-B-39-22069, JP-B-43-13168, JP-B-62-273527, U.S. Pat. Nos. 3,247,127, 3,469,985 and 4,078,933; other oxonol dyestuffs disclosed in U.S. Pat. Nos. 2,533,472 and 3,379,533, British Patent 1,278,621, JP-A-1-134447 and JP-A-1-183652; azo dyestuffs disclosed in British Patents 575,691, 680,631, 599, 623, 786,907, 907,125, 1,045,609, U.S. Pat. No. 4,255,326, JP-A-59-211043; azomethine dyestuffs disclosed in JP-A-50-100116, JP-A-54-118247, British Patents 2,014,598 and 750,031; anthraquinone dyestuffs disclosed in U.S. Pat. No. 2,865,752; arylidene dyestuffs disclosed in U.S. Pat. Nos. 2,538,009, 2,538,009, 2,668,541 and 2,538,008, British Patents 584,609 and 1,210,252, JP-A-50-40625, JP-A-51-3623, JP-A-51-10927, JP-A-54-118247, JP-B-48-3286 and JP-B-59-37303; styryl dyestuffs disclosed in JP-B-28-3082, JP-B-44-16594 and JP-B-59-28898; triarylmethane dyestuffs disclosed in British Patents 446,538 and 1,335,422 and JP-A-59-288250; merocyanine dyestuffs disclosed in British Patents 1,075,653, 1,153,341, 1,284,730, 1,475,228 and 1,542,807; and cyanine dyestuffs disclosed in U.S. Pat. Nos. 2,843,486 and 3,294,539, and JP-A-1-291247. The methine compounds of the present invention can be used as the above-described dyestuffs and, in this case, the compounds are advantageous in that they can be easily discolored.

In order to prevent diffusion of these dyestuffs, the following methods can be used.

For example, one of the methods comprises incorporating a ballast group into the dyestuff thereby making it anti-diffusible.

In another method, a hydrophilic polymer having an electric charge opposite to that of the dissociated anionic dyestuff is co-existent as a mordant, and the dyestuff is localized in a specific layer by an interaction between the hydrophilic polymer and the dyestuff molecule as disclosed in U.S. Pat. Nos. 2,548,564, 4,124,386 and 3,625,694.

A still another method comprises dyeing a specific layer with a metal salt fine particle onto which the dyestuff has been adsorbed as disclosed in U.S. Pat. Nos. 2,719,088, 2,496,841 and 2,496,843, and JP-A-60-45237.

A further method comprises dyeing a specific layer using a solid dispersion of a water-insoluble dye as disclosed in JP-A-56-12639, JP-A-55-155350, JP-A-55-155351, JP-A-63-27838, JP-A-63-197943, and European Patent 15,601.

The dyestuff used in the present invention is incorporated into silver halide emulsion layers and/or other hydrophilic colloidal layers for the purposes of antihalation, prevention of irradiation, improvement in the safety to a safelight and improvement in the front-back surface judgement, and the dye is required to satisfy the following conditions:

(1) the dyestuff has a spectral absorption suitable for the purpose of the desired utility;

(2) the dyestuff should be photochemically inactive, i.e., it should not adversely affect, in a chemical sense, the performance of the silver halide photographic emulsions, for example, adverse affects such as a sensitivity reduction, a latent image fading or fogging;

(3) the dyestuff should be discolored during photographic processings or eluted into a processing solution or into water for washing, without leaving any troublesome coloring on the photographic material after processing;

(4) the dyestuff should not diffuse from the dyed layer to other layers; and (5) the dyestuff has a stability with time in a solution or a photographic material and does not undergo a color change or a color fading.

Dyestuffs satisfying the above requirements and usable in the present invention include the solid dispersed dyes disclosed in, for example, JP-A-56-12639, JP-A-55-155350, JP-A-55-155351, JP-A-63-27838, JP-A-63-197943, European Patents 15,601, 274,723, 276,566 and 299,435, International Patent (WO) 88/04794, JP-A-2-264936 and JP-A-4-14035.

Specific examples of the dyestuffs used in the present invention are as follows, but the dyestuffs are not limited thereto:

S-1

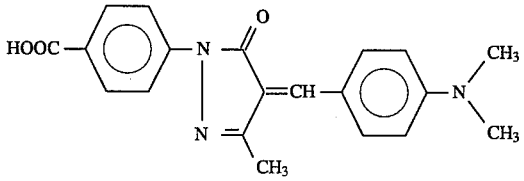

S-2

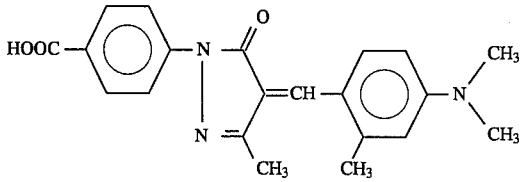

S-3

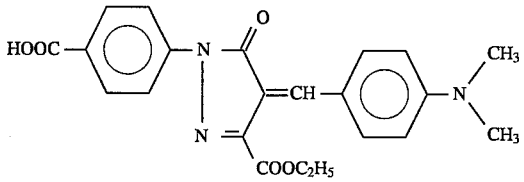

S-4

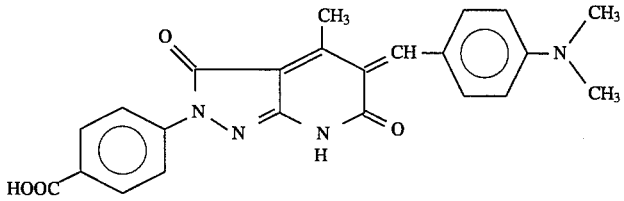

S-5

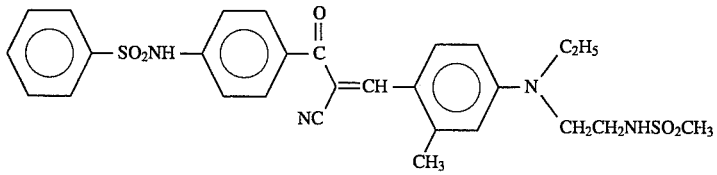

S-6

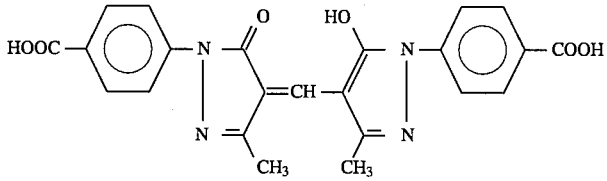

S-7

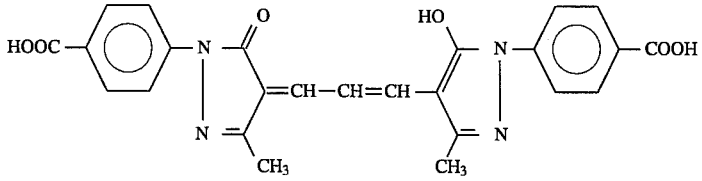

S-8

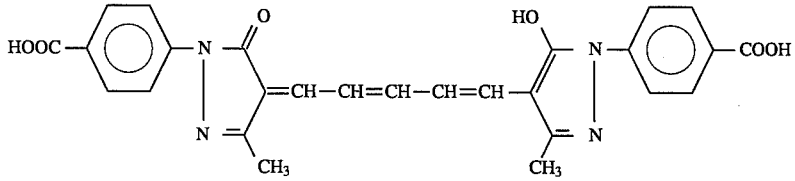

-continued
S-9
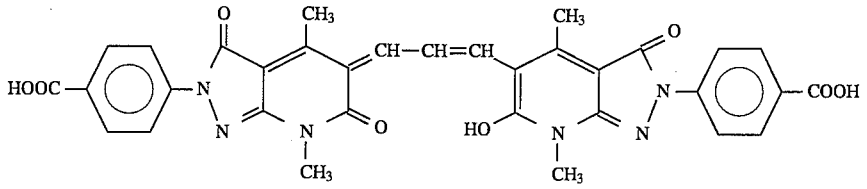
S-10
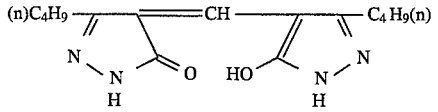
S-11
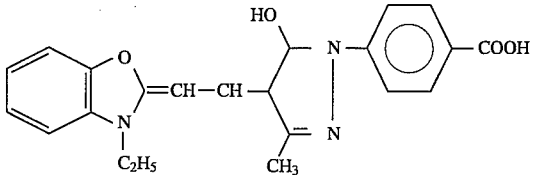
S-12
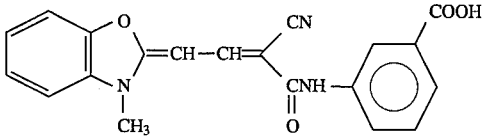
S-13
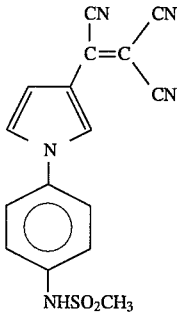
S-14
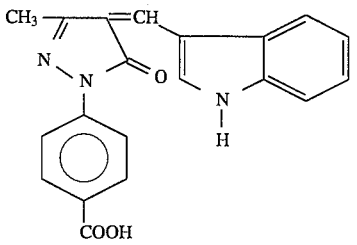
S-15
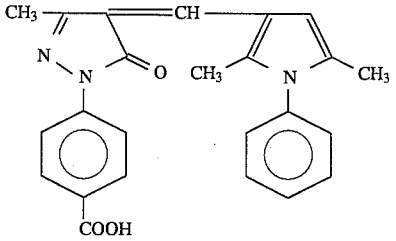

-continued

S-16

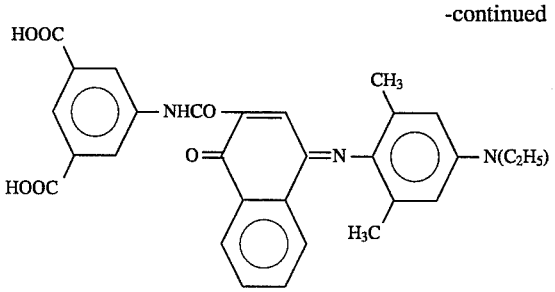

The dyestuffs used in the present invention can be easily synthesized by the methods as well as the procedures according to the methods disclosed in, for example, published unexamined International Publication WO88/04794, EP-A-0274723, EP-A-0276566, EP-A-0299435, JP-A-52-92716, JP-A-55-155350, JP-A-55-155351, JP-A-61-205934, JP-A-48-68623, U.S. Pat. Nos. 2,527,583, 3,486,897, 3,746,539, 3,933,798, 4,130,429 and 4,040,841, JP-A-3-7931, JP-A-2-282244, and JP-A-1-307363.

A method for preparing such dyestuffs is described in published unexamined International Patent (WO) 88/04794, EP-A-0276556 and JP-A-63-197943, but generally the dyestuff is pulverized in a ball mill and stabilized with a surface active agent and gelatin.

The dyestuff in the dispersion used in the present invention is present as a fine solid having an average particle size of from 0.1 μm to 0.6 μm and a coefficient of variation in the particle size distribution of 50% or less. More preferably, the dyestuff has an average particle size of from 0.1 to 0.5 μm and more preferably a dyestuff dispersion having an average particle size of from 0.1 to 0.5 μm and a coefficient of variation of 35% or less.

The coefficient of variation as referred to above is represented by a value calculated by dividing the standard deviation (S) by an average diameter (d), i.e., (S/d), in the distribution represented by the diameter when the projected area is approximated to a circle.

The amount of the dyestuff used is from 5 mg/m$^2$ to 300 mg/m$^2$, preferably from 10 mg/m$^2$ to 150 mg/m$^2$.

When the dispersed solid of dyestuff is used as a filter dyestuff or an antihalation dyestuff, the dyestuff dispersion can be used in an any effective amount, but preferably it is used in such an amount that the optical density becomes in the range of from 0.05 to 3.5. The dyestuff dispersion can be added at any stage prior to the coating.

In the silver halide photographic material according to the present invention, a protective layer is preferably provided on the above-described emulsion layer provided on the support. Also, a back layer may be provided on the back side (on the side having no emulsion layer) of the support. The silver halide photographic material of the present invention may be a structure composed of a back layer, a support, an antihalation layer, an emulsion layer, an intermediate layer, a ultraviolet absorption layer and a protective layer. When a dye or dyestuff is used in these layers, the use of the methine compound according to the present invention is preferred since it can be easily discolored.

To the silver halide photographic emulsion used in the present invention may be added, as a protective colloid, gelatin as well as an acylated gelatin such as gelatin phthalate and gelatin malonate, a cellulose compound such as hydroxyethyl cellulose and carboxymethyl cellulose; a soluble starch such as dextrin; a hydrophilic polymer such as polyvinyl alcohol, polyvinyl pyrrolidone, polyacrylamide and polystyrenesulfonic acid; a plasticizer for dimensional stability; and a latex polymer and a matting agent. The finished emulsion is coated on an appropriate support, for example, a baryta paper, a resin-coated paper, a synthetic paper, a plastic base such as a triacetate film, a polyethylene terephthalate film, a polyethylene naphthalate film or a glass plate.

The exposure to light for obtaining a photographic image can be conducted in a conventional manner. That is, any of various known light sources such as a natural light (sun light), a tungsten lamp, a mercury lamp, a xenon arc lamp, a carbon arc lamp, a xenon flash lamp, a laser, an LED and a CRT can be used. The exposure time can be from 1/1000 second to 1 second generally used in a camera as well as an exposure time shorter than 1/1000 second, for example, an exposure time of from 1/10$^4$ to 1/10$^8$ second by a xenon fluorescent lamp can also be used. If desired, a spectral composition of the light used for the exposure can be adjusted with a color filter. As set forth above, a laser beam can be used for the exposure. Further, the exposure can be conducted with a light emitted from a fluorescent material excited by an electron beam, an X-ray, a γ-ray or an α-ray.

The spectral sensitizing dyes of the present invention (the methine compounds represented by the above formulae (1) and (2)) are used for the sensitization of silver halide photographic emulsions for various color and black and white photographic materials. The emulsions which can be used include a color positive emulsion, an emulsion for the color paper, a color negative emulsion, a color reversal emulsion (which may or may not contain a coupler), an emulsion used in the photographic material for plate-making (for example, a lithographic film), an emulsion used in the light-sensitive material for a cathode ray tube display, an emulsion used for a silver salt diffusion transfer process, an emulsion used for a color diffusion transfer process, an emulsion used for an Imbitio transfer process (disclosed in, for example, U.S. Pat. No. 2,882,156), an emulsion used for a silver dye bleaching method, an emulsion used for a material for recording a print-out image (disclosed in, for example, U.S. Pat. No. 2,369,449), an emulsion used for a direct print image light-sensitive material (disclosed in, for example, U.S. Pat. No. 3,033,682) and an emulsion used for a heat-developable color light-sensitive material.

The photographic processings of the light-sensitive material of the present invention can be conducted by unitizing conventional methods as described in *Research Disclosure.*, No. 176, pages 28–30 (RD-17643), and conventional processing solutions can be used for these photographic processings. The processing temperature is adjusted between 18° C. and 50° C., but a temperature below 18° C. or higher than 50° C. may be used. According to the purpose, either a development processing for forming a silver image (a black and white photographic processing) or a color photographic processing comprising a developing processing for forming an color image can be applied.

For a black and white developing solution, well known developers such as dihydroxybenzenes (for example, hydroquinone), 3-pyrazolidones (for example, 1-phenyl-3pyrazolidone), aminophenols (for example, N-methyl-p-aminophenyl) can be used alone or in combination.

The color developing solution generally comprises an alkaline aqueous solution containing a color developer. The color developer which can be used includes known primary aromatic amine developers, for example, phenylenediamines (e.g., 4-amino-N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-hydroxyethylaniline, 3-methyl-4-amino-N-ethyl-N-β-methanesulfoaminoethylaniline and 4-amino-3-methyl-N-ethyl-β-methoxyethylaniline).

In addition to the above, developers described in L. F. A. Meson, *Photographic Processing Chemistry*, Focal Press (1966), pages 226–229, U.S. Pat. Nos. 2,193,015 and 2,592,364, JP-A-48-64933 can be used.

The developing solution may also contain a pH buffering agent such as an alkali metal sulfite, carbonate, borate and phosphate, a bromide, a development inhibitor such as an organic antifoggant, or an antifoggant. Also, if desired, the developing solution may contain a softener for hard water, a preservative such as hydroxylamine, an organic solvent such as benzyl alcohol and diethylene glycol, a development accelerator such as polyethylene glycol, a quaternary ammonium salt and an amine, a dye-forming coupler, a competing coupler, a foggant such as sodium borohydride, an auxiliary developer such as 1-phenyl-3-pyrazolidone, a thickening agent, a polycarboxylic acid type chelating agent described in U.S. Pat. No. 4,083,723, and an antioxidant described in German Patent Application OLS No. 2,622,950.

When the photographic material is subjected to a color photographic processing, the photographic material after the color development is generally subjected to a bleaching processing. The bleaching may be effected simultaneously with fixing, or these processings may be carried out separately. Typical examples of bleaching agents which can be used are organic complex salts of iron (III), cobalt (III), chromium (VI) and copper (II), peroxides, quinones and nitroso compounds. For example, ferricyanates, bichromate, organic complex salts of iron (III) or cobalt (III), e.g., aminopolycarboxylic acids such as ethylenediamine tetracomplex salt, nitrilotriacetic acid, 1,3-diamino-2-propanoltetraacetic acid or complex salts of organic acids such as citric acid, tartaric acid and malic acid; persulfates and permanganates; and nitrophenol can be used. Of these compounds, potassium ferricyanate, sodium ethylenediamine tetracomplex salt iron (III) and ammonium ethylenediamine tetracomplex salt iron (III) are particularly useful. The ethylenediamine tetracomplex salt iron (III) complex salt is useful in the independent bleaching solution or a single bath bleaching-fixing solution.

A bleaching accelerator disclosed in, for example, U.S. Pat. Nos. 3,042,520 and 3,241,966, JP-B-45-8506 and JP-B-45-8836, a thiol compound disclosed in JP-A-53-65732, and other various additives can be added to the bleaching solution or the bleaching-fixing solution. Also, after bleaching or bleaching-fixing processing, a washing processing may be conducted or a only stabilizing bath processing may be conducted.

Various additives and development processings used for the light-sensitive material of the present invention are not limited and, for example, those described in the following places can be preferably used.

1) Silver Halide Emulsion and Method for Preparation Thereof

The selenium sensitizing methods disclosed in JP-A-2-97937 page 20, lower right column, line 12 to page 21, lower left column, line 14; JP-A-2-12236, page 7, upper right column, line 19 to page 8, upper left column, line 12; and JP-A-5-11389.

2) Spectral Sensitizing Dye (which can be used together)

The spectral sensitizing dyes disclosed in JP-A-2-55349, from page 7, upper left column, line 8 to page 8, lower right column, line 8; JP-A-2-39042, from page 7, lower right column, line 8 to page 13, lower right column, line 5; JP-A-2-12236, from page 8, lower left column, line 13 to page 8, lower right column, line 4; JP-A-2-103536, from page 16, lower right column to page 17, lower left column, line 20; as well as JP-A-1-112235, JP-A-2-124560, JP-A-3-7928, JP-A-5-11389.

3) Hydrazine Nucleating Agent

The disclosures in JP-A-2-12236, from page 2, upper right column, line 19 to page 7, upper right column, line 3; and Formula (II) and Compound Examples II-1 to II-54 described in JP-A-3-174143, from page 20, lower right column, line 1 to page 27, upper right column, line 20.

4) Nucleating Accelerator

Formulas (II-m) to (II-p) and Compound Examples II-1 to II-22 described in JP-A-2-103536, from page 9, upper right column, line 13 to page 16, upper left column, line 10; and the compounds disclosed in JP-A-1-179939.

5) Surface Active Agent

The surface active agents disclosed in JP-A-2-12236, from page 9, upper right column, line 7 to page 9, lower right column line 7; and JP-A-2-18542, from page 2, lower left column, line 13 to page 4, lower right column, line 18.

6) Anti-foggant

Disclosures in JP-A-2-103536, from page 17, lower right column, line 19 to page 18, upper right column, line 4 to page 18, upper right column, line 4, and page 18, lower right column lines 1 to 5; and the thiosuifinic acid compounds disclosed in JP-A-1-237538.

7) polymer Latex

JP-A-2-103536, page 18, lower left column, lines 12 to 20.

8) Matting Agent, Slipping Agent, and Plasticizer

JP-A-2-103536, from page 19, upper left column, line 15 to page 19, upper right column, line 15.

9) Polyhydroxybenzenes

JP-A-2-55349, page 11, upper left column, page 9 to page 11, lower right column, line 17.

10) Compounds having Acid Group

JP-A-2-103536, from page 18, lower right column, line to page 19, upper left column, line 1; and JP-A-2-55349, from line 8, lower right column, line 13 to page 11, upper left column, line 8.

11) Dyestuff

JP-A-2-103536, from page 17, lower right column, lines 1 to 18; and JP-A-2-39042, from page 4, upper right column, line 1 to page 6, upper right column, line 5.

12) Binder

JP-A-18542, page 3, lower right column, lines 1 to 20.

13) Black

Compounds disclosed in U.S. Pat. No. 4,956,257 and JP-A-1-118832.

14) Redox Compound

Compounds represented by Formula (I) (in particular, Compound Examples 1 to 50) of JP-A-2-301743; Formulae (R-1), (R-2) and (R-3), Compound Examples 1 to 75 disclosed in JP-A-3-174143, from pages 3 to 20; and the compounds disclosed in JP-A-5-257239 and JP-A-4-278939.

15) Monomethine Compound

Compounds of Formula (II) (in particular, Compound Examples II-1 to II-26) of JP-A-2-287532.

16) Dihydroxybenzenes

Disclosure in JP-A-3-39948, from page 11, upper left column to page 12, upper left column, and compounds disclosed in EP-A-452772.

17) Developing Solution and Development Method

JP-A-2-1035356, from line 19, upper right column, line 16 to page 21, upper left column, line 8; and JP-A-2-55349, from page 13, lower right column, line 1 to page 16, upper left column, line 10.

The present invention is further illustrated in greater detail by way of the following examples, but it should be understood that the present invention is not to be deemed to be limited thereto.

EXAMPLE 1

Preparation of Emulsion

Solution 2 and Solution 3 shown in Table 1 were added at the same time to Solution 1 maintained at 64° C. over a period of 5 minutes while stirring, and subsequently Solution 4, Solution 5 and Solution 6 shown in Table 1 were added thereto over a period of 40 minutes while controlling a pAg at 7.8 whereby a monodisperse cubic silver iodobromide emulsion having an average grain diameter of 0.24 μm and an average iodine content of 1 mol % was finally obtained (a coefficient of variation: 8%). Thereafter, the emulsion was washed with water by the flocculation method according to a conventional procedure, and, after added gelatin thereto, the mixture was adjusted to a pH of 6.8 and a pAg of 8.0. Then, 13.8 mg of sodium thiosulfate, 4.6 mg of auric acid chloride, 17 mg of potassium thiocyanate and 6.5 mg of benzenethiosulfonic acid were added thereto to effect a chemical sensitization so as to obtain an optimum sensitivity at 65° C.

Further, 75 mg of 2-methyl-4-hydroxy-1,3,3a,7-tetrazaindene as a stabilizer and 2 g of phenoxyethanol as a preservative were added thereto to obtain a silver iodobromide cubic emulsion A.

TABLE 1

| | |
|---|---|
| Solution 1: | |
| Gelatin | 20 g |
| Potassium bromide | 3 g |
| Benzenethiosulfonic acid | 5 mg |
| 1,3-Dimethylimidazolidine-2-thione | 6 mg |
| Water to make | 900 ml |
| Solution 2: | |
| Silver nitrate | 18.9 g |
| Water to make | 85 ml |
| Solution 3: | |
| Potassium bromide | 13.9 g |
| Water to make | 60 ml |
| Solution 4: | |
| Silver nitrate | 151 g |
| Water to make | 680 ml |

TABLE 1-continued

| | |
|---|---|
| Solution 5: | |
| Potassium bromide | 106 g |
| Potassium iodide | 1.5 g |
| Water to make | 455 ml |

Preparation of Coated Sample:

The compound represented by formula (5) and the sensitizing dye of the present invention, and each of the comparative compounds shown below were added in the amount indicated in Table 2 to the above-prepared Emulsion A.

Dye-1

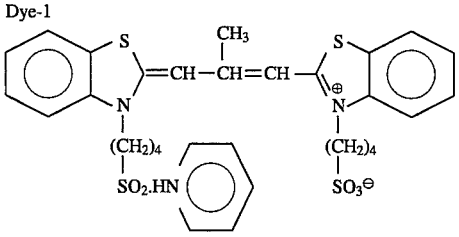

Dye-2

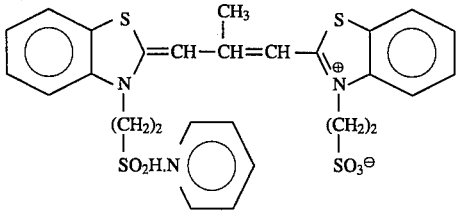

Comparative Compound (A) (Comp. (A)):

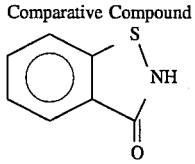

Further, 100 mg of Compound-1 shown below, 29 mg of 1-phenyl-5-mercaptotetrazole, 10 mg of sodium 3-(5-mercaptotetrazole)-benzenesulfonate, 2.5 g of 4-hydroxy-6-methyl-1,3,3a,7-tetrazaindene and 0.8 g of potassium bromide were added thereto.

Furthermore, phosphoric acid was added to the emulsion to adjust a pH to 5.5, and sodium polystyrenesulfonate as a thickening agent in an amount of 20 mg per gram of gelatin, polyethylacrylate latex (an average particle diameter, 0.05 μm) as a plasticizer in an amount of 30% by weight relative to gelatin and 2-bis(vinylsulfonylacetoamido)ethane as a hardening agent were added thereto. The resulting solution was then coated simultaneously with the following dye layer and the protective layer. The emulsion layer was coated so as to give 1.4 g/m$^2$ of the silver amount, 1.3 g/m$^2$ of gelatin and 100 mg/m$^2$ of the hardening agent.

| | |
|---|---|
| Dye Layer: | |
| Gelatin | 1.5 g/m$^2$ |
| Solid Dispersed Dye S-8* | 80 mg/m$^2$ |
| Solid Dispersed Dye S-10* | 20 mg/m$^2$ |
| Sodium polystyrenesulfonate | 25 mg/m$^2$ |
| Dyestuff (1) | 40 mg/m$^2$ |
| Dyestuff (2) | 8 mg/m$^2$ |

-continued

| | |
|---|---|
| Sodium Dodecylbenzenesulfonate | 15 mg/m$^2$ |
| Phosphoric acid | 15 mg/m$^2$ |
| Protective Layer: | |
| Gelatin | 0.5 g/m$^2$ |
| Polymethyl methacrylate latex (an average particle diameter, 0.9 μm) | 25 mg/m$^2$ |
| Compound-2 (gelatin dispersion) | 40 mg/m$^2$ |
| Compound-3 | 8 mg/m$^2$ |
| Sodium benzenesulfonate | 5 mg/m$^2$ |
| Colloidal silica | 88 mg/m$^2$ |
| Compound-4 | 5 mg/m$^2$ |
| L-Ascorbic acid | 10 mg/m$^2$ |
| 1,5-Dihydroxy-2-benzaldoxime | 5 mg/m$^2$ |
| Sodium acetate | 100 mg/m$^2$ |
| Sodium polystyrenesulfonate | 15 mg/m$^2$ |

Compound-1:

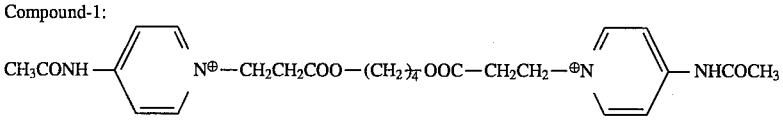

Dyestuff (1):

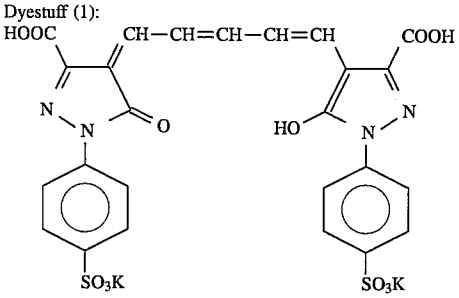

Dyestuff (2):

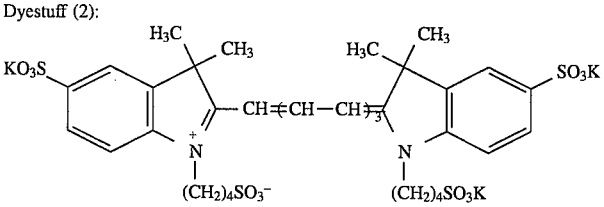

Compound-2:

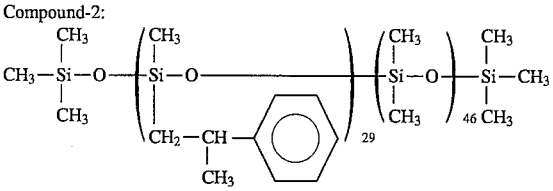

Compound-3:

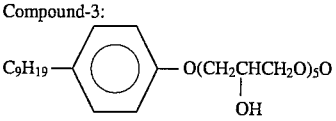

Compound-4:

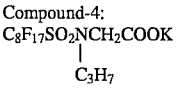

*Preparation Method of Solid Dispersed Dye

The preparation method in the present invention was in accordance with the method of JP-A-63-197943. That is, 434 ml of water and 53 g of a 6.7% solution of a surface active agent, Triton X-200R (TX-200R, a product of Rohm & Haas) were placed into a 1.5 liter bottle with a screw cap. To the bottle were added 20 g of a dye and 800 ml of beads (2 mm diameter) of zirconium oxide ($ZrO_2$), and, after closing the cap of the bottle tightly, the bottle was placed in a mill and the content was pulverized for 4 days. The content was added to 160 g of a 12.5% aqueous solution of gelatin, and the mixture was placed in a roll mill for 10 minutes to reduce foams. The resulting mixture was filtered to remove $ZrO_2$ beads. The mixture thus-obtained had an average particle diameter of 0.3 μm, but still contained coarse particles and, therefore, is was sieved by centrifugation to obtain a dispersed dye having a maximum particle size of 1 μm or less.

The base used for the above-described coating was a polyethylene naphthalate base and had an electroconductive layer and a protective layer of the following compositions.

| | |
|---|---|
| (1) Electroconductive Layer: | |
| Julymer ET410 (produced by Nippon Junyaku Co., Ltd.)(a polyacrylate) | 38 mg/m$^2$ |
| $SnO_2$/Sb (9/1 weight ratio, average particle size: 0.25 μm) | 216 mg/m$^2$ |
| Compound-5 | 5 mg/m$^2$ |
| Compound-6 | 6 mg/m$^2$ |
| (2) Protective Layer: | |
| Chemipearl S120 (produced by Mitsui Petrochemical Industries, Ltd.) (an aqueous dispersion of polyolefin) | 33 mg/m$^2$ |
| Snowtex C (produced by Nissan Chemical Industries, Ltd.) | 17 mg/m$^2$ |
| Compound-5 | 5 mg/m$^2$ |
| Compound-7 | 5 mg/m$^2$ |
| Sodium polystyrenesulfonate | 2 mg/m$^2$ |

Compound-5:

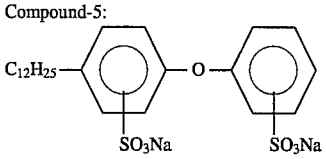

Compound-6:

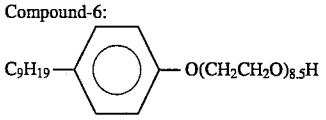

Compound-7:

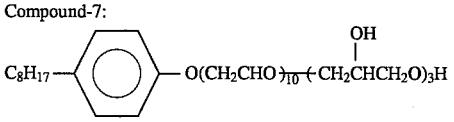

Evaluation of Photographic Performance Evaluation of Sensitivity:

The resulting sample was exposed to a tungsten light having a color temperature of 2856K (intensity of illumination, 100 lux) through a continuous wedge for ⅕ second. The exposed sample was processed using AP-5 automatic developing machine produced by Fuji Photo Film Co., Ltd. at a processing rate of 3.5 m per minutes. The developing solution and the fixing solution used were MD-285 and MF-585, respectively, produced by Fuji Photo Film Co., Ltd. A reciprocal of the exposure amount giving a density of 1.2 was referred to as the sensitivity which is shown in Table 2 in terms of a relative sensitivity.

Evaluation of Residual Color:

An unexposed sample was processed in an automatic developing machine in the same manner as in the sample used for the evaluation of sensitivity, and a color tone of the overlaid three processed films was visually evaluated in five ranks, i.e., an integer of from 5 to 1. In the results of the evaluation shown in Table 2, "5" stands for the best quality and "1" stands for the worst quality.

Evaluation of Preservability:

Samples were allowed to stand for 3 days under high temperature and humidity conditions of 50° C. and 75% RH. Thereafter, the samples were exposed to light and processed in the same manner as in the evaluation of sensitivity. In this case, samples naturally allowed to stand were also processed simultaneously, and the sensitometry was performed. The difference in the sensitivity between the samples which have been naturally allowed to stand and the samples which have been stored under high temperature and humidity are shown in Table 2.

TABLE 2

| | Sensitizing Dye | | Compound of Formula (5) | | | | | |
|---|---|---|---|---|---|---|---|---|
| Sample No. | Kind | Amount (mol/Agmol) | Kind | Amount (mol/Agmol) | Relative Sensitivity | Preservability (ΔSensitivity) | Residual color | Remarks |
| 1 | — | — | — | — | 10 | −15 | 5 | Comparison |
| 2 | — | — | Comp. (A) | 0.1 | 10 | −15 | 5 | Comparison |
| 3 | — | — | II-1 | 0.1 | 10 | −20 | 5 | Comparison |
| 4 | Dye-1 | $1 \times 10^{-4}$ | — | — | 70 | −30 | 3 | Comparison |
| 5 | Dye-1 | $1 \times 10^{-4}$ | Comp. (A) | 0.1 | 70 | −30 | 3 | Comparison |
| 6 | Dye-1 | $1 \times 10^{-4}$ | II-1 | 0.1 | 79 | −25 | 2 | Comparison |
| 7 | Dye-1 | $5 \times 10^{-4}$ | — | — | 100 | −40 | 2 | Comparison |
| 8 | Dye-1 | $5 \times 10^{-4}$ | Comp. (A) | 0.1 | 100 | −40 | 2 | Comparison |
| 9 | Dye-1 | $5 \times 10^{-4}$ | II-1 | 0.1 | 110 | −48 | 1 | Comparison |
| 10 | Dye-2 | $1 \times 10^{-4}$ | — | — | 50 | −25 | 4 | Comparison |
| 11 | Dye-2 | $1 \times 10^{-4}$ | Comp. (A) | 0.1 | 50 | −25 | 4 | Comparison |
| 12 | Dye-2 | $1 \times 10^{-4}$ | II-1 | 0.1 | 65 | −25 | 4 | Comparison |
| 13 | Dye-2 | $5 \times 10^{-4}$ | — | — | 80 | −38 | 3 | Comparison |
| 14 | Dye-2 | $5 \times 10^{-4}$ | Comp. (A) | 0.1 | 80 | −38 | 3 | Comparison |
| 15 | Dye-2 | $5 \times 10^{-4}$ | II-1 | 0.1 | 95 | −38 | 3 | Comparison |
| 16 | I-6 | $1 \times 10^{-4}$ | — | — | 65 | −30 | 5 | Comparison |
| 17 | I-6 | $1 \times 10^{-4}$ | Comp. (A) | 0.1 | 65 | −30 | 5 | Comparison |
| 18 | I-6 | $1 \times 10^{-4}$ | II-1 | 0.1 | 88 | −15 | 5 | Invention |
| 19 | I-6 | $5 \times 10^{-4}$ | — | — | 80 | −40 | 5 | Comparison |
| 20 | I-6 | $5 \times 10^{-4}$ | Comp. (A) | 0.02 | 80 | −40 | 5 | Comparison |
| 21 | I-6 | $5 \times 10^{-4}$ | Comp. (A) | 0.1 | 80 | −40 | 5 | Comparison |
| 22 | I-6 | $5 \times 10^{-4}$ | II-1 | 0.02 | 110 | −20 | 5 | Invention |
| 23 | I-6 | $5 \times 10^{-4}$ | II-1 | 0.1 | 130 | −15 | 5 | Invention |
| 24 | I-9 | $5 \times 10^{-4}$ | — | — | 85 | −35 | 5 | Comparison |
| 25 | I-9 | $5 \times 10^{-4}$ | Comp. (A) | 0.1 | 85 | −35 | 5 | Comparison |

TABLE 2-continued

| Sample No. | Sensitizing Dye Kind | Sensitizing Dye Amount (mol/Agmol) | Compound of Formula (5) Kind | Compound of Formula (5) Amount (mol/Agmol) | Relative Sensitivity | Preservability (ΔSensitivity) | Residual color | Remarks |
|---|---|---|---|---|---|---|---|---|
| 26 | I-9 | $5 \times 10^{-4}$ | II-1 | 0.02 | 115 | −20 | 5 | Invention |
| 27 | I-9 | $5 \times 10^{-4}$ | II-1 | 0.1 | 140 | −15 | 5 | Invention |

From the results shown in Table 2, it is understood that Sample Nos. 18, 22, 23, 26 and 27 according to the present invention are excellent in the sensitivity, the residual color and the preservability as compared with the samples of comparative examples. Also, in comparing Sample Nos. 22 and 23, and Sample Nos. 26 and 27, it is understood that the compound represented by formula (5) exhibits a sufficient effect even when added in a small amount, but, when the addition amount is increased, a more excellent effect can be obtained.

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having provided thereon at least one light-sensitive silver halide emulsion layer, wherein the emulsion is spectrally sensitized with at least one compound selected from the compounds represented by the following formulae (1) and (2) and contains a compound represented by the following formula (5):

$$[DYE]\text{-}(G)_n \quad (1)$$

$$[DYE]\text{-}(G^-)_n \quad (2)$$

wherein DYE represents a methine dye; G and $G^-$ each represents a substituent of the methine dye, wherein G and $G^-$ are represented by the following formula (3) and (4) respectively; and n is an integer of from 1 to 3:

$$-T^1-G^1NHG^2 \quad (3)$$

$$-T^1-G^1N^0G^2 \quad (4)$$

wherein $T^1$ represents a divalent linking group; $G^1$ represents a carbonyl group, a sulfinyl group or a sulfonyl group; $G^2$ represents $-CO-T^2$, $-SO-T^2$, $-SO_2-T^2$ or a cyano group; and $T^2$ represents a monovalent group:

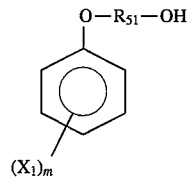

(5)

wherein $R_{52}$ represents an unsubstituted an alkylene group having from 1 to 6 carbon atoms; $X_1$ represents a halogen atom, a nitro group, an akyl group, a substituted or unsubstituted amino group, $-CO-R_{52}$ or $-SO_3M$, in which $R_{52}$ represents a hydrogen atom, —OM, an alkyl group, an alkoyl group or a substituted or unsubstituted amino group; M represents a hydrogen atom, an alkali metal atom or an atomic group which is a monovalent cation; and m represents 0 or an integer of from 1 to 5;

wherein the compound represented by formula (5) is added in an amount of 0.05 mol or more per mol of the silver halide.

2. The silver halide photographic material as claimed in claim 1, which further comprises at least one of a 1-phenyl-5-mercaptotetrazole compound.

3. The silver halide photographic material as claimed in claim 1, wherein the photographic material is a black and white photographic material.

* * * * *